US006187081B1

(12) United States Patent
Sures et al.

(10) Patent No.: US 6,187,081 B1
(45) Date of Patent: Feb. 13, 2001

(54) NON-AQUEOUS FOUNTAIN SOLUTION COMPOSITION

(75) Inventors: R. H. Sures; Trevor Law; Jeffrey H. Rose, all of Hollywood, FL (US)

(73) Assignee: Allied Pressroom Chemistry, Hollywood, FL (US)

( * ) Notice: Under 35 U.S.C. 154(b), the term of this patent shall be extended for 0 days.

(21) Appl. No.: 09/263,547

(22) Filed: Mar. 8, 1999

(51) Int. Cl.[7] ..... G09D 5/20
(52) U.S. Cl. ..... 106/2; 101/450.1
(58) Field of Search ..... 106/2; 101/450.1

(56) References Cited

U.S. PATENT DOCUMENTS 4,925,761 * 5/1990 Kulisz, Sr. et al. ..... 106/2
5,054,394 * 10/1991 Zweig ..... 106/2

* cited by examiner

*Primary Examiner*—C. Melissa Koslow
(74) *Attorney, Agent, or Firm*—Scott L. Lampert

(57) ABSTRACT

A non-aqueous fountain solution composition for use with offset printing systems prepared by dry blending 2–25% by weight of a film forming agent, 2.5–50% by weight of an acid, 2.5–50% by weight of an acid salt combination, 0.5–1.5% by weight of a biocide, 0–10% by weight of a sequestrant, 0–25% by weight of a corrosion inhibitor, 0–10% by weight of a humectant, and 0–5% by weight of an anti-foaming agent.

21 Claims, No Drawings

NON-AQUEOUS FOUNTAIN SOLUTION COMPOSITION

BACKGROUND OF THE INVENTION

1. Field of the Invention

The present invention relates to fountain solutions for use in lithographic printing operations and, more particularly, to a non-aqueous fountain solution.

2. Description of the Related Art

Offset printing, or lithography, is a printing technique in which the image to be printed is fixed on a generally flat plate. The lithographic process is based on the principal that oil and water do not mix. Using this principal, the plate is constructed so that the image areas are ink receptive and lipophilic or water repellant and the non-image areas are hydrophilic or water receptive and ink repellant. Fountain solutions, also referred to as dampening solutions, are the agents used in lithography to wet the non-image area of the plate and repel the ink from such non-image areas.

Numerous patented and unpatented fountain solutions have been developed over the past several years. By far, the vast majority of such prior art fountain solutions are aqueous or liquid based. U.S. Pat. Nos. 5,279,648, 5,268,025, 5,336,302, 5,382,298, 4,865,646 and 4,604,952 exemplify the state of the prior art liquid based fountain solution.

Although somewhat useful for their intended purpose, the prior art aqueous fountain solutions have been found to have many inherent deficiencies. Many of these solutions use alcohol, typically isopropyl alcohol at a level of 10–15 percent, as an additive to fountain solutions. The alcohol reduces the surface tension of the aqueous fountain solution and acts as a wetting agent, viscosity modifier, emulsification aid and anti-foam agent. However, because of its volatile organic compound (VOC) characteristic, and resultant health and environmental effects, the use of alcohol is undesirable. Moreover, alcohol is an added cost and tends to reduce the quality of the printed material. Additionally, the aqueous solutions cause the containers holding such solutions to be heavy and cumbersome, resulting in significant storage, handling and freight costs. Moreover, the aqueous nature of these solutions increases the potential of environmental contamination following spillages and exposure to potentially harmful vapors from VOCs during manufacture and use of the solutions. Also, even after the aqueous solution has been consumed, disposal of the empty containers may pose environmental and health hazards.

In view of such health hazards, more recent aqueous fountain solutions, such as those disclosed in U.S. Pat. Nos. 5,279,648, 5,268,025, 5,336,302 and 4,865,646, have been developed without alcohol. However, many of these non-alcohol, aqueous fountain solutions employ other VOCs or chemicals considered to be harmful, such as ethylene glycol monobutyl ether, some of which are now regulated or prohibited by federal or state laws due to their inherent environmental and health hazards. Furthermore, the use of the alternative surface active agents often result in further undesirable properties, such as foaming and ink over emulsification. Additionally, these non-alcohol aqueous solutions still include the deficiencies inherent in aqueous solutions discussed above.

Notwithstanding the above identified problems inherent in aqueous fountain solutions, fountain solutions commercially available today are still predominately aqueous and, consequently, still include the inherent deficiencies discussed above. A few non-aqueous solutions, such as those disclosed in U.S. Pat. Nos. 4,234,443 and 4,374,036, have been developed, but have generally not been commercially successful. U.S. Pat. No. 4,234,443 discloses an alkaline fountain solution, which the inventor, Canale, claims addresses problems with image deterioration and ink-receptiveness of background areas associated with acidic solutions, thereby improving the transference of the ink to the paper on which the image is being printed. However, in U.S. Pat. No. 4,374,036, Canale acknowledges that alkaline solutions, such as those disclosed in his earlier patent, also interfere with the transference of the ink to the paper and, consequently, discloses a neutral solution to address such problem.

Although the non-aqueous fountain solutions disclosed in U.S. Pat. Nos. 4,234,443 and 4,374,036 eliminate some of the problems discussed above inherent in aqueous solutions, they are designed for generally lower quality web fed type printing, such as newsprint, and are not well-suited for use with the modern high speed printing presses used today in commercial multi-color printing. Specifically, the neutral and alkaline solutions are not capable of rendering the properties required for use with today's newer, faster equipment for a variety of reasons. First, the increased speed and improved performance of today's newer equipment necessitates a corresponding speed and performance improvement of its collateral products, such as the cleansing and wetting capabilities of fountain solutions. The neutral and alkaline solutions do not cleanse the plate fast and effective enough to accommodate the increasing speeds of today's presses. In fact, some of today's newer systems will not function correctly at a pH greater than 4.0. Second, although alkaline based solutions were suitable for use with older generation inks based on mineral oils, they are generally incompatible with newer generation inks comprising vegetable oils, such as soy, linseed and rapeseed. When a vegetable oil and alkali are mixed, the resultant chemical reaction produces a water soluble soap, which adversely effects the equipment's performance and resultant quality of the printed material.

Accordingly, there is a need in the art for a non-aqueous, acid-based fountain solution composition capable of achieving the speed and performance criteria required by today's newer high speed multi-color lithographic printing systems. Any such composition should include a surfactant system capable of attaining dynamic surface tension measurements similar to those generated by aqueous solutions having isopropyl alcohol, without foaming, ink over-emulsification and other undesirable properties, and be capable of reducing the quantity of alcohol required for optimum performance. The present invention is particularly suited to overcome those problems which remain in the art in a manner not previously known.

SUMMARY OF THE INVENTION

The present invention is directed towards a new and improved non-aqueous fountain solution composition for use with offset printing systems prepared by dry blending 2–25% by weight of a film forming agent, 2.5–50% by weight of an acid, 2.5–50% by weight of an acid salt combination, 0.5–1.5% by weight of a biocide, 0–10% by weight of a sequestrant, 0–25% by weight of a corrosion inhibitor, 0–10% by weight of a humectant, and 0–5% by weight of an anti-foaming agent.

It is an object of the present invention to provide a fountain solution which has all the advantages of the prior art devices and none of the disadvantages.

It is another object of the present invention to provide a non-aqueous fountain solution composition.

It is still a further object of the present invention to provide such a composition which may be conveniently packaged, shipped and stored in an efficient, economical and environmentally safe manner.

It is also an object of the present invention to provide such a composition which is acid-based.

It is yet another object of the present invention to provide such a composition which reduces the quantity of alcohol required for optimum performance.

It is a further object of the present invention to provide such a composition which minimizes VOC emissions and the corresponding potential health and environmental hazards.

It is yet a further object of the present invention to provide such a composition which includes a surfactant system capable of attaining dynamic surface tension measurements similar to those generated by aqueous solutions having isopropyl alcohol.

These and other objects and advantages of the present invention will become more readily apparent in the description which follows.

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

The present invention is directed towards a new and improved non-aqueous fountain solution composition for use with offset printing systems. The composition is prepared by dry blending 2–25% by weight of a film forming agent, 2.5–25% by weight of an acid, 2.5–50% by weight of an acid salt combination, 0.5–1.5% by weight of a biocide, 0–10% by weight of a sequestrant, 0–25% by weight of a corrosion inhibitor, 0–10% by weight of a humectant, and 0–5% by weight of an anti-foaming agent. The composition may be provided in solid or powder form and is structured to be added to water at appropriate levels for use as a dampening or fountain solution in lithographic printing systems.

The film forming agent is preferably sodium carboxyl methyl cellulose of the type manufactured by Aqualon Chemical Company under the trade name Ambergum 1221. However, other suitable film forming agents may, alternatively, be employed. The film forming agent is structured to create a hydrophilic film over the non-image areas of the plate, thereby shielding such non-image areas from the subsequently applied ink.

The acid and acid salt combination is structured to achieve the desired pH value in the composition. Citric acid and sodium citrate are the preferred acid and acid salt, respectively, but any other suitable acid and acid salt may, alternatively, be used.

The biocide is structured to preserve the composition during storage and in use by impeding the growth of and destroying any fungus or microorganisms that may be present in the composition. Sodium benzoate is the preferred biocide, but any other suitable biocide may, alternatively, be used.

The sequestrant is structured to counteract the effects of dissolved calcium and other interfering agents introduced to the fountain solution with the addition of water. Without the introduction of the sequestrant, the calcium and other interfering agents tend to react with ingredients in the ink and fountain solution to create scale and sludge in the offset printing system. The sequestrant is preferably a sodium salt of ethylene diamine tetra acetic acid of the type manufactured by Dow Chemical Company under the trade name Versene 220. However, other suitable sequestrants may, alternatively, be employed.

The corrosion inhibitor is structured to protect the printing plate, press and associated components from corrosion. Sodium nitrate and sodium phosphate are the preferred corrosion inhibitors, but any other suitable anti-corrosive item or items may, alternatively, be used.

The humectant is structured to prevent the printing plate from drying too rapidly and to maintain the properties of the film formers. A high molecular weight polyethylene glycol is the preferred humectant, but any other suitable humectant may, alternatively, be used.

The anti-foaming agent is structured to prevent the formation of foam after the composition is mixed with water. The anti-foaming agent is preferably a dry silica based defoamer of the type manufactured by Dow Chemical Company under the trade name Anti-Foam 1920. However, other suitable anti-foaming agents may, alternatively, be employed.

It should be appreciated that the fountain solution composition of the present invention may be embodied in a wide range of operable formulations as illustrated by the examples below.

EXAMPLE 1

| Ingredient | Percent By Weight |
|---|---|
| Ambergum 1221 | 22.00 |
| Sodium Citrate | 28.25 |
| Citric Acid | 19.25 |
| Versene 220 | 7.25 |
| Sodium Benzoate | 1.35 |
| High Molecular Weight Polyethylene Glycol | 7.25 |
| Solid Anti-Foam 1920 | 0.15 |
| Sodium Nitrate | 7.25 |
| Sodium Phosphate | 7.25 |

EXAMPLE 2

| Ingredient | Percent By Weight |
|---|---|
| Ambergum 1221 | 22.00 |
| Sodium Citrate | 36.15 |
| Citric Acid | 11.35 |
| Versene 220 | 7.25 |
| Sodium Benzoate | 1.35 |
| High Molecular Weight Polyethylene Glycol | 7.25 |
| Solid Anti-Foam 1920 | 0.15 |
| Sodium Nitrate | 7.25 |
| Sodium Phosphate | 7.25 |

EXAMPLE 3

| Ingredient | Percent By Weight |
|---|---|
| Ambergum 1221 | 20.00 |
| Sodium Citrate | 45.50 |
| Citric Acid | 9.00 |
| Versene 220 | 5.25 |
| Sodium Benzoate | 1.35 |
| High Molecular Weight Polyethylene Glycol | 5.25 |
| Solid Anti-Foam 1920 | 0.15 |
| Sodium Nitrate | 6.75 |
| Sodium Phosphate | 6.75 |

Each of the above compositions were formulated in a free-flowing powder. The composition of Example 1 was mixed at a ratio of 1.5 pounds per 55 gallons of water and was used as a press ready fountain solution with no further additives in a printing press equipped with a so-called conventional dampening system with molleton covered rollers.

The composition of Example 2 was mixed with water at ratios varying from between 1 pound per 55 gallons to 3 pounds per 55 gallons. 110 ounces of a proprietary alcohol substitute, commonly used to reduce VOC emissions, was added to the solutions. The resultant solutions were used with a Komori printing press fitted with a Komorimatic dampening system, a so-called alcohol dampening system. In such a system, the dampening solution is required to rapidly wet metallic (rollers and printing plates) and polymeric (rollers) surfaces. Waste levels were found to be at or below standard levels and the resultant print quality was equal to or higher than that normally obtained from this machine using conventional aqueous fountain solutions.

The composition of Example 3 was initially mixed at a ratio of 1 pound per 55 gallons of untreated tap water. The resultant solution was used with a GOSS Metroliner newspaper press, a web offset printing press equipped with a conventional dampening system and using conventional newsprint inks. The quantity of ink required to produce acceptable printed matter was found to be lower with this composition than with conventional fountain solutions, indicating improvements in wetting, desensitization of non-image areas of the plate and reduction in emulsification of the ink. Further trials were performed at ratios of powdered composition to water of between 0.2% to 0.5%, all producing acceptable results in terms of quality and waste.

The foregoing examples illustrate that the non-aqueous fountain solution composition of the present invention may be embodied in a wide range of operable formulations and is suitable for use in all aspects of offset lithographic printing, from small single color presses to large format web offset presses. Moreover, it is capable of use with or without alcohol and alcohol substitutes to reduce VOC emissions and its attendant environmental and health hazards.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A non-aqueous composition suitable for production of a fountain solution comprising quantities of 2–25% by weight of a film forming agent in combination with 2.5–50% by weight of an acid, 2.5–50% by weight of an acid salt combination, 0.5–1.5% by weight of a biocide, 0–10% by weight of a sequestrant, 0–25% by weight of a corrosion inhibitor, 0–10% by weight of a humectant and 0–5% by weight of an anti-foaming agent.

2. A composition suitable for production of a fountain solution as recited in claim 1 wherein said film forming agent is sodium carboxyl methyl cellulose.

3. A composition suitable for production of a fountain solution as recited in claim 1 wherein said acid is citric acid.

4. A composition suitable for production of a fountain solution as recited in claim 1 wherein said acid salt combination is sodium citrate.

5. A composition suitable for production of a fountain solution as recited in claim 1 wherein said biocide is sodium benzoate.

6. A composition suitable for production of a fountain solution as recited in claim 1 wherein said sequestrant is a sodium salt of ethylene diamine tetra acetic acid.

7. A composition suitable for production of a fountain solution as recited in claim 1 wherein said corrosion inhibitor is sodium nitrate.

8. A composition suitable for production of a fountain solution as recited in claim 1 wherein said corrosion inhibitor is sodium phosphate.

9. A composition suitable for production of a fountain solution as recited in claim 1 wherein said humectant is polyethylene glycol.

10. A composition suitable for production of a fountain solution as recited in claim 1 wherein said anti-foaming agent is a dry silica based defoamer.

11. A composition suitable for production of a fountain solution comprising quantities of 2–25% by weight of a film forming agent in combination with 2.5–50% by weight of citric acid, 2.5–50% by weight of sodium citrate, 0.5–1.5% by weight of sodium benzoate, 0–10% by weight of a sequestrant, 0–25% by weight of a corrosion inhibitor, 0–10% by weight of a humectant and 0–5% by weight of an anti-foaming agent.

12. A composition suitable for production of a fountain solution as recited in claim 11 wherein said corrosion inhibitor is sodium nitrate.

13. A composition suitable for production of a fountain solution as recited in claim 11 wherein said corrosion inhibitor is sodium phosphate.

14. A composition suitable for production of a fountain solution as recited in claim 11 wherein said humectant is polyethylene glycol.

15. A composition suitable for production of a fountain solution comprising quantities of 2–25% by weight of a film forming agent in combination with 2.5–50% by weight of citric acid, 2.5–50% by weight of sodium citrate, 0.5–1.5% by weight of sodium benzoate, 0–10% by weight of a sequestrant, 0–10% by weight of sodium phosphate, 0–10% by weight of sodium nitrate, 0–10% by weight of polyethylene glycol and 0–5% by weight of an anti-foaming agent.

16. A non-aqueous composition suitable for production of a fountain solution comprising quantities of 2–25% by weight of a film forming agent in combination with 2.5–50% by weight of an acid, 2.5–50% by weight of an acid salt combination, 0–10% by weight of a sequestrant, 0–25% by weight of a corrosion inhibitor, 0–10% by weight of a humectant and 0–5% by weight of an anti-foaming agent.

17. A composition suitable for production of a fountain solution as recited in claim 4 wherein said acid is citric acid.

18. A composition suitable for production of a fountain solution as recited in claim 4 wherein said biocide is sodium benzoate.

19. A composition suitable for production of a fountain solution as recited in claim 4 wherein said corrosion inhibitor is sodium nitrate.

20. A composition suitable for production of a fountain solution as recited in claim 4 wherein said corrosion inhibitor is sodium phosphate.

21. A composition suitable for production of a fountain solution as recited in claim 4 wherein said humectant is polyethylene glycol.

* * * * *